US005897458A

United States Patent [19]

Farhat

[11] Patent Number: 5,897,458

[45] Date of Patent: Apr. 27, 1999

[54] METHOD AND APPARATUS FOR IMPROVING AN EXERCISER

[76] Inventor: Joseph E. Farhat, 7717 Division St. South, St. Louis Park, Minn. 55426

[21] Appl. No.: 08/794,366

[22] Filed: Feb. 4, 1997

Related U.S. Application Data

[63] Continuation-in-part of application No. 08/673,440, Jun. 28, 1996, abandoned

[60] Provisional application No. 60/030,461, Nov. 6, 1996.

[51] Int. Cl.[6] ..... A63B 23/04

[52] U.S. Cl. ..... 482/52

[58] Field of Search ..... 482/51, 52, 53, 482/57, 54, 58, 62

[56] References Cited

U.S. PATENT DOCUMENTS 4,708,338 11/1987 Potts ..... 482/52

OTHER PUBLICATIONS

Sports Tech Services, Inc., Parts and Services Catalog, Spring/Summer 1996.

*Primary Examiner*—Stephen R. Crow

*Attorney, Agent, or Firm*—Patterson & Keough, P.A.

[57] ABSTRACT

The disclosure relates to a method and device for improving the reliability, maintainability, performance and safety of exercise machines. Generally, the improvement includes installing wear resistant devices and frictionless bearings to promote consistent and predictable resistance accompanied by fluidic and sustained machine operation. The improvement further includes installing a shielding mechanism to guard the mechanical components of the exercise machine from environmental contamination and to further enable draining fluids away from vital mechanical parts. The shield also serves as a safe barrier between the users of the machine and its operating electrical and mechanical parts.

12 Claims, 6 Drawing Sheets

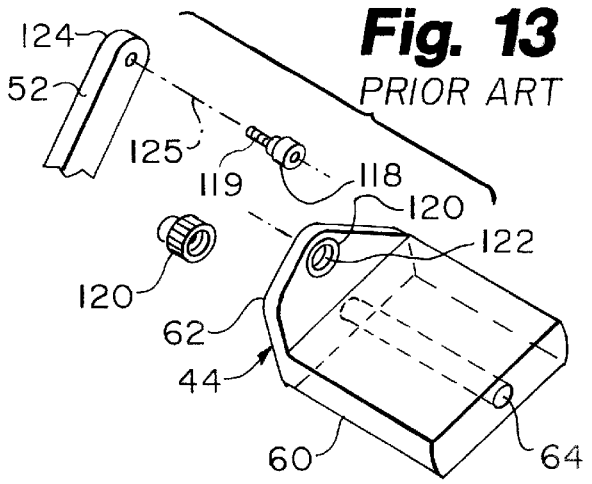
Fig. 13
PRIOR ART
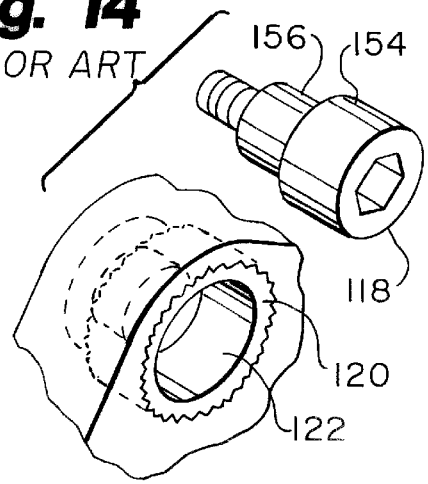
Fig. 14
PRIOR ART
Fig. 15
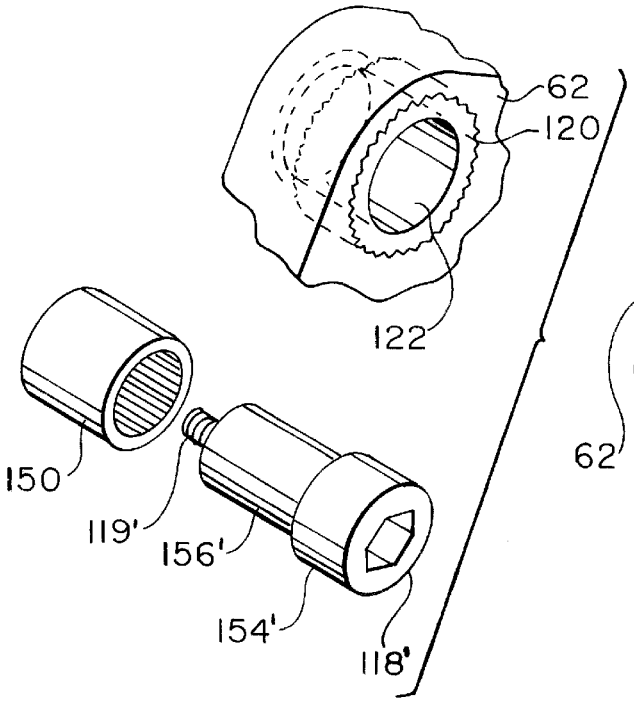
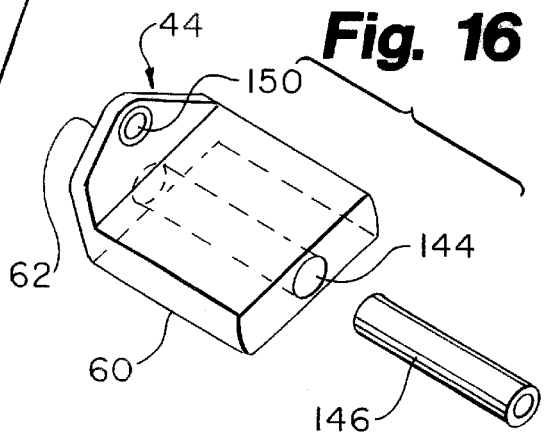
Fig. 16

METHOD AND APPARATUS FOR IMPROVING AN EXERCISER

CROSS-REFERENCES TO RELATED APPLICATIONS

This is a continuation-in-part of U.S. patent application Ser. No. 08/673,440, filed Jun. 28, 1996, now abandoned and of U.S. Provisional Application No. 60/030,461, filed Nov. 6, 1996.

FIELD OF THE INVENTION

The present invention generally relates to exercise machines. Specifically, the invention relates to the enhancement of the performance of exercise machines. More specifically, the invention pertains to replacement devices and method to improve the performance, reliability, safety and maintainability of exercise machines of the stair climbing simulator type.

BACKGROUND OF THE INVENTION

Losing weight and achieving total-body fitness have become popular with the public at large. Towards this end, exercise machines are extensively used both in private homes and gymnasia. Most exercise machines are compatible for indoor use and provide maximum control of workout and feedback of the exerciser's speed, pulse, calories, time and related data. Generally, most people use aerobic exercise machines by setting their exercise targets within their maximum aerobic zone. This and similar modes of exercise often impose cyclic and random wear on critical components of the exercise machine. Specifically, because of the large variance in the mode of use, exercise machines in commercial gymnasia and health clubs are exposed to undue wear and stress which generally exceed the design and safety margins of the component parts. This results in unreliable adjustments and resistance and yields false workout feedback. Further, users encounter jerky, non-fluid and inconsistent resistance to their exertions which results in unsatisfactory exercise experience and, at times, renders the exercise machines dangerous.

Accordingly, there is a need to improve the design of exercise machines such that the life cycle of critical components could be extended to promote safe and effective use of the machines.

SUMMARY OF THE INVENTION

The present invention provides, inter alia, a device and method for extending the useful life of an exercise machine. The device and method include a dynamic interface means for improving wear resistance, reliability and maintainability of moving parts at initial stress points within the machines. Further, the improvement includes means for shielding internal mechanisms of the machine and to collect and drain liquids away from said internal mechanisms of the machine. The dynamic interface means may include an improved pedal arm shaft assembly. The improved pedal arm shaft assembly may further include an improved pedal arm shaft sleeve and an improved pedal arm shaft. The improved pedal arm shaft is disposed within a generally coaxial bore, the bore being disposed within the improved pedal arm shaft sleeve.

The dynamic interface means may also include an improved tubular member on each of a left and right pedal arm. The improved tubular member will include a generally coaxial bore and a plurality of bearings disposed within the bore. The inner race of each bearing ideally defines an improved bore. The improved tubular member may further include a sleeve disposed within the bore, the sleeve having a first and second ends. The first and second ends of each sleeve may be disposed proximate to at least one laterally disposed bearing.

The dynamic interface means may further include an improved chain attachment mechanism. The improved chain attachment mechanism may further include an improved bushing and an improved sleeve disposed with the bushing. The improved bushing and the improved sleeve may be impregnated/flooded with a lubricating substance. The dynamic interface means may also include left and right leveling arms, each leveling arm with a tubular member, each tubular member with at least one bearing. The inner race of each bearing defines an improved bore.

The dynamic interface means may further include improved left and right pedals, each improved pedal having a horizontal member and a vertical member. The horizontal member of each improved pedal may include an enlarged bore, the enlarged bore accommodating a generally tubular sleeve disposed about a shaft of a pedal arm. The improved sleeve may further include an impregnated lubricating substance. Each vertical member includes a bushing and an improved pivoting assembly disposed therewithin. The improved pivoting assembly may further include a needle bearing disposed within the bushing and a shoulder bolt disposed within the needle bearing and being threadably joinable to a leveling arm.

The shielding/shrouding means may include a top shield. The top shield/shroud may be of a complementary shape in which the top shield overlays, closely fits, and encloses a portion of each of two underlying shields which enclose the internal mechanisms of the exercise machine.

The top shield may further include a central member, a first member, and a second member. The first and second members may be flankingly attached to the central member. The central member is generally U-shaped in cross section and includes a first base, a second base and an apex region. The first and second members may extend integrally and generally laterally from the first and second bases of the central member, respectively. The first and second members may each further include planar and sloped elements. The planar element of the first and second member integrally extend from the first and second bases, respectively. A sloped element integrally and laterally extends from a frontal portion of each planar element. The shield may further include a first skirt and a second skirt extending generally downwardly from the first and second sloped elements, respectively. Furthermore, the shield may include a first and a second rear wall. The first and second rear walls generally and orthogonally abut against rear termini of the first and second planar elements, respectively. The first and second rear walls may extend above and laterally beyond each planar element. The central member may further include a depressed portion on the apex area proximate a forward terminus.

BRIEF DESCRIPTION OF THE DRAWINGS

FIG. 13 is an exploded view of the prior art pedal.

FIG. 14 is an enlarged fragmentary perspective detail of a portion of FIG. 13.

FIG. 15 in an enlarged fragmentary perspective detail similar to that of FIG. 14 in which the piece has been reworked and replaced with invention parts.

FIG. 16 is a view similar to that of FIG. 13 in which the invention has been incorporated.

DETAILED DESCRIPTION OF THE DRAWINGS

Comprehension of the present invention can be gained through reference to the drawings in conjunction with a thorough review of the following explanation. In order to facilitate a full appreciation of the invention, an overview of the preferred embodiment is initially provided. The overview is followed by a detailed explanation of the improvements.

The improvements disclosed herein are advantageously and generically applicable to exercise machines of the stair climbing simulator type. One of such types of exercise equipment is disclosed in U.S. Pat. No. 4,708,338. For illustrative purposes only, the Applicant has elected to use the assembly drawings of the equipment in the above-cited patent with the present invention implemented therein. However, no claim of right is made to the patent. Further, this prior art of record is neither appropriated nor incorporated other than for the exemplary purpose it is intended to provide herein. Furthermore, the elements of the present invention are neither disclosed nor suggested by the patent and are distinctly separate and independent of the assembly drawings.

Figure 1:
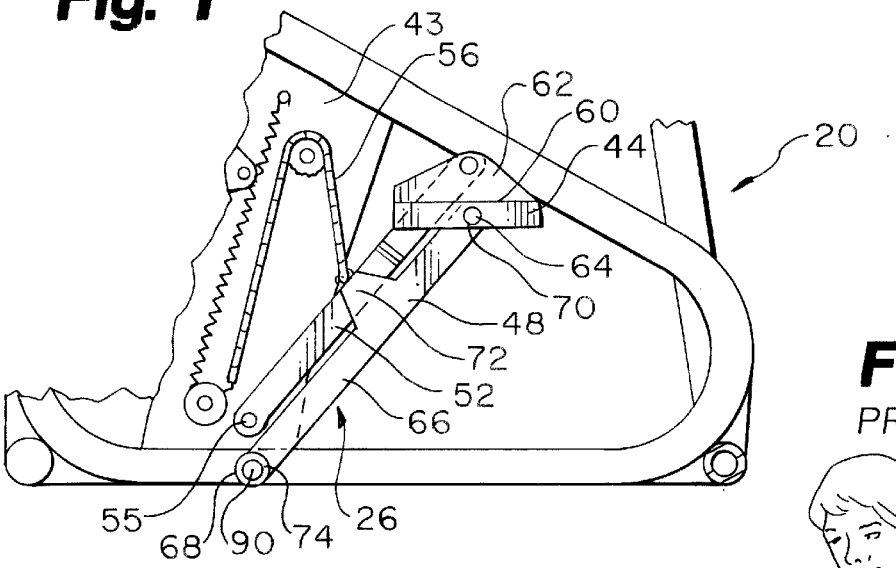
FIG. 1 is a perspective view of the prior art device showing its left side, its front and slightly above.

FIG. 1 depicts an improved stair climbing exercise apparatus 20 of the prior art upon which person 22 is exercising. Stair climbing exercise apparatus 20 generally includes frame 24, mechanical assembly 26, and control panel 28. Frame 24 includes lower horizontal member 30, rear lateral support member 32, front lateral support member 34, vertical support member 36, transverse support member 38 and inclined support member 40. Horizontal support member 30 is generally perpendicular to rear lateral support member 32 and to front lateral support member 34. Vertical support member 36 extends generally vertically from front lateral support member 34. Generally, transverse support member 38 extends from rear lateral support member 32 and proceeds generally vertically and then transversely at a bend, finally adjoining vertical support member 36 generally at a midpoint. Inclined support member 40 extends from two laterally disposed sites on rear lateral support member 32 and proceeds generally vertically, then transversely at a bend. Support member 40 adjoins member 36 at a central position approximately midway between two frontally disposed bends. Grips 42 may be installed on member 40.

Figure 2:
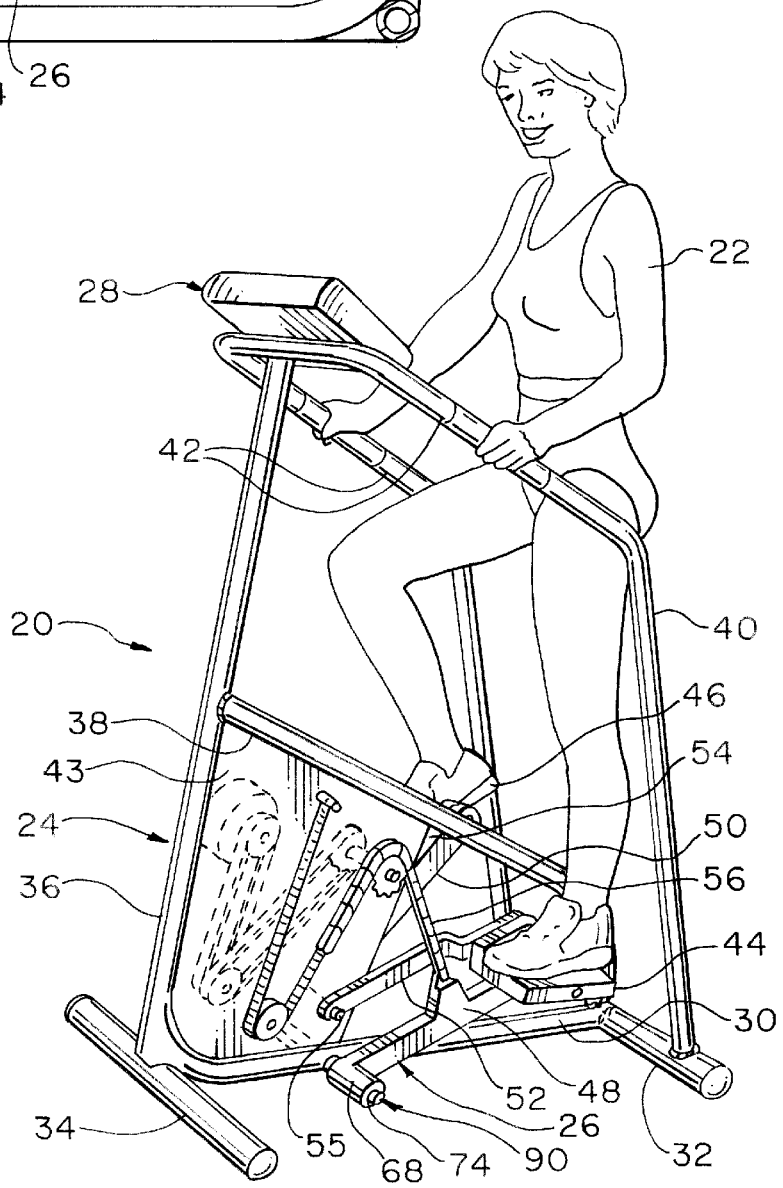
Fig. 2 PRIOR ART
FIG. 2 is a fragmentary left side view of the prior art of FIG. 1.

Referring to FIGS. 1 and 2, mechanical assembly 26 includes plate 43, left pedal 44, right pedal 46, left pedal arm 48, right pedal arm 50, left leveling arm 52, right leveling arm 54, leveling arm shaft 55, left chain 56, and a right chain (not depicted). Vertically oriented plate 43 extends between support members 30, 36 and 38 and provides anchoring sites for many of the mechanical elements of mechanical assembly 26.

Figure 3:
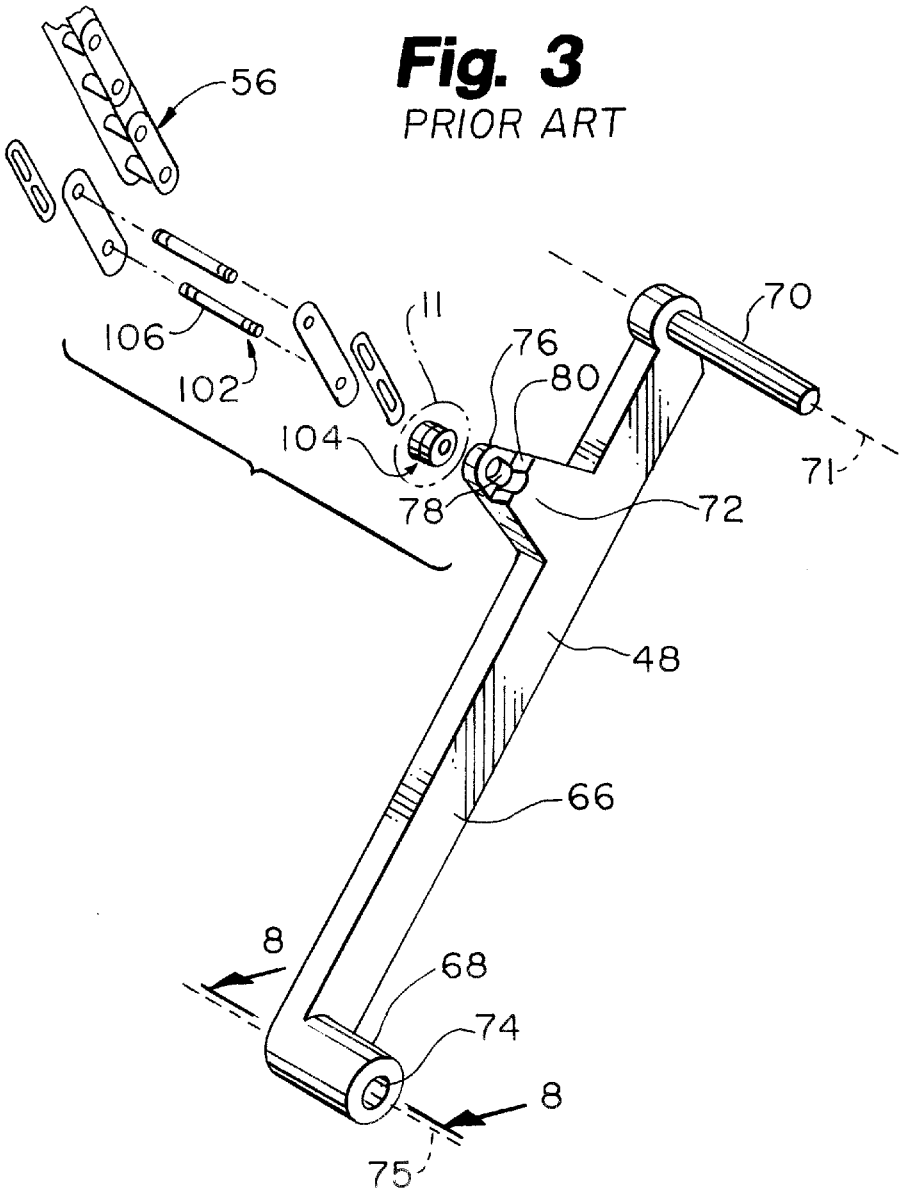
Fig. 3 PRIOR ART
FIG. 3 is a detailed exploded view, showing the prior art of a portion of FIG. 2.
Figure 4:
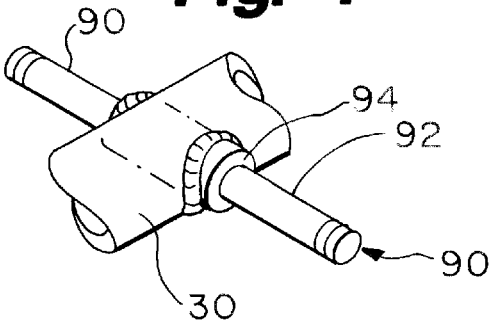
FIG. 4 is a fragmentary detailed perspective view of the prior art.
Figure 5:
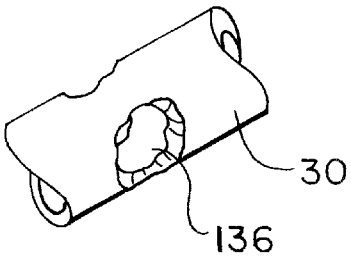
FIG. 5 is a view similar to FIG. 4 in which the mechanical parts have been removed therefrom.
Figure 6:
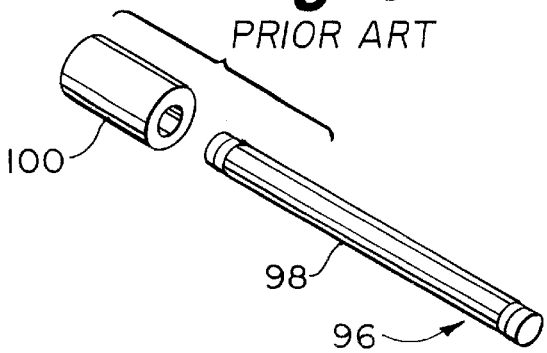
Fig. 6 PRIOR ART
FIG. 6 is an exploded detailed view of the prior art.
Figure 7:
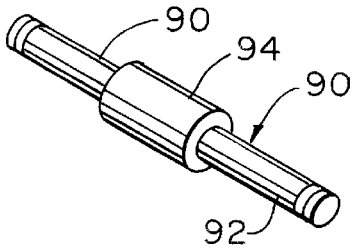
Fig. 7 PRIOR ART
FIG. 7 is a perspective view of the prior art.

Left pedal 44 includes horizontal pedal member 60 and vertical pedal member 62 (FIGS. 2, 3 and 13). Bore 64 extends along a generally centrally disposed longitudinal axis of horizontal member 60. Although not depicted, corresponding elements are also present in right pedal 46.

Referring to FIG. 3, left pedal arm 48 generally includes main linear portion 66, a lower tubular member 68, shaft portion 70, and winglet 72. Tubular member 68 includes centrally located and coaxially disposed bore 74. Tubular member 68, hence bore 74, is generally perpendicular to the longitudinal axis of linear portion 66. Winglet 72 further includes tab 76 and bore 78, bore 78 disposed within tab 76. Also present on winglet 72, adjacent to tab 76, is shoulder 80. Axis 71 of shaft 70 and axis 75 of tubular member 68 are ideally parallel. Although not depicted, right pedal arm 50 includes corresponding elements with respect to left pedal arm 48.

Pedal arm shaft assembly 90 is disposed within and generally perpendicularly to the longitudinal axis of lower horizontal member 30 (FIGS. 4–7). Pedal arm shaft assembly 90 is a one-piece element including smaller diameter portion 92. Smaller diameter portion 92 extends from larger diameter portion 94. Smaller diameter portion 92 may have a diameter of ¾ inch and a length of 8 inches. Larger diameter portion 94 may have a diameter of 1 inch and a length of 2½ inches. Alternatively, pedal arm shaft assembly 96 may be present within, and perpendicular to, the longitudinal axis of lower horizontal member 30. Shaft assembly 96 includes smaller diameter shaft portion 98 slidably disposed within sleeve 100. Shafts 92 and 98 would ideally have equal dimensions as would larger diameter portion 94 and sleeve 100.

Figure 11:
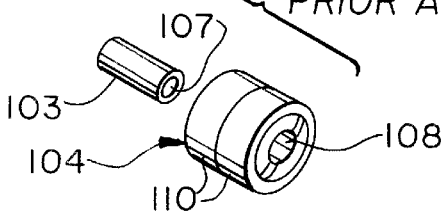
Fig. 11 PRIOR ART
FIG. 11 is a perspective view of the prior art.

Referring to FIG. 11, bearing assembly 104 includes sleeve 103 and two bearings 110. Coaxial bore 107 is present within sleeve 103. Coaxial bore 108 is defined by the inner race of each of bearings 110. Sleeve 103 resides within bore 108 of each bearing 110. Chain 56 attaches to winglet 72 of left pedal arm 48 by means of master link 102. Bearing assembly 104 is disposed within bore 78 (FIG. 3). Pin 106 of master link 102 is disposed within bore 107 of sleeve 103.

Figure 8:
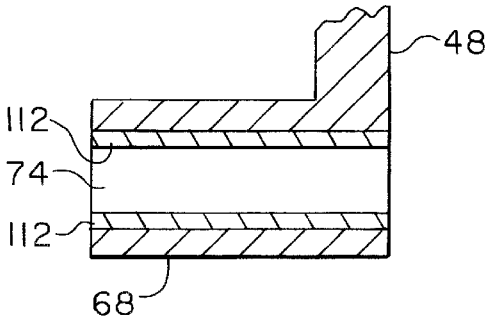
Fig. 8 PRIOR ART
FIG. 8 is a longitudinal sectional view of the lower portion of FIG. 3 taken along line 8—8 of FIG. 3.

Disposed within bore 74 of member 68 is sleeve 112 (FIGS. 8, 3). In use, either shaft 92 or shaft 98 (FIGS. 4, 6) may be disposed within bore 74. Corresponding elements are present on right pedal arm 50.

Figure 17:
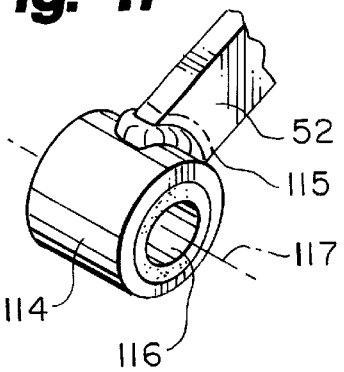
FIG. 17 is a detailed fragmentary perspective view of prior art.

Referring to FIG. 17, left leveling arm 52 terminates in tubular member 114. Tubular member 114 includes coaxial bore 116. The axis 117 of bore 116 is generally perpendicular to the longitudinal axis of leveling arm 52.

As shown in FIG. 13, left pedal 44 attaches to leveling arm 52 by means of shoulder bolt 118, which is seated within bushing 120. Bushing 120, in turn, is disposed within bore 122. Bore 122 is located in vertical member 62. Attachment to left leveling arm 52 is effected by rotating the threads 119 of shoulder bolt 118 such that they are received within the threads (not depicted) of bore 124 on left leveling arm 52.

Left pedal 44 is mounted on left pedal arms 48 by disposing shaft 70 within bore 64 (FIGS. 2, 13). Corresponding elements are present on right pedal 46.

As shown by FIGS. 4, 6, 7 and 8, sleeve 112 and either shaft 92 or 98 normally rub against each other as pedal arms 46, 48 are pivoted during use. This rubbing causes both sleeve 112 and shaft 92, 98 to abrade and wear away, thereby eroding the formerly close tolerances between these elements. Another result of rubbing is the build up of heat, which causes metal fatigue. When the formerly close tolerances no longer exist, pedal arms 48, 50 cannot pivot smoothly on shaft 92 or 98 and often seize during use. This results in a jerky movement, which yields unsatisfactory exercise experience and may lead to false and inaccurate workout feedback and could also be dangerous.

Figure 9:
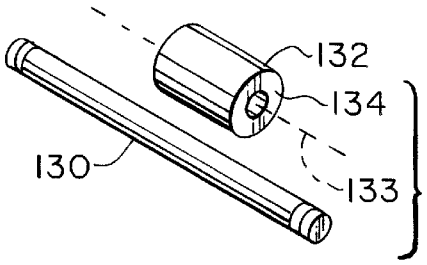
FIG. 9 is a perspective view of the two-part composition of a portion of the invention.

As shown in FIG. 9, an improved pedal arm shaft 130 is disposed within improved sleeve 132, which in turn, is disposed within lower horizontal member 30. By way of illustration and not limitation, improved pedal arm shaft 130 may have a diameter between about 15 mm and 19 mm and ideally has a diameter of about 17 mm. Improved pedal arm shaft 130 may have a length between about 7⅞ inches and 8⅛ inches and ideally has a length of about 8 inches. Improved sleeve 132 may have an outer diameter between about ⅞ inch and 1⅛ inches and a length between about 2⅜ inches and 2⅝ inches. Ideally, improved sleeve 132 has an outer diameter of about 1 inch and a length of about 2½ inches. Moreover, improved pedal arm shaft 130 and improved sleeve 132 may be impregnated or coated with lubricants, or be made of Oil-Lite™ or of equivalent friction-reducing materials.

In practice, pedal arm shaft assembly 90 or 96 of the prior art is removed from within horizontal member 30 by the use of an acetylene torch or other known means. Longitudinal axis 133 of improved sleeve 132 is then aligned to be generally coaxially parallel with shaft 55. Both improved pedal arm shaft 130 and bore 134 within sleeve 132 are of a smaller diameter than shafts 92 and 98 of the prior art. However, the outer diameter of sleeve 132 is equal to the outer diameter of either sleeve 100 or larger diameter portion 94. Improved sleeve 132 and shaft 130 therewithin, are seated within opening 136 which is created by removing pedal arm shaft 90, 96 of the prior art from horizontal member 30. Sleeve 132 and shaft 130 are preferably made from suitable steel or steel alloys as are known within the art.

Figure 10:
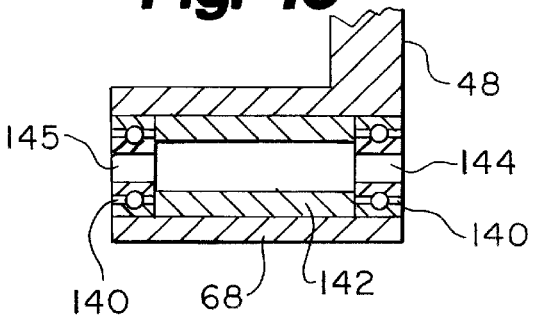
FIG. 10 is a view similar to that of FIG. 8 in which parts have been removed and replaced to facilitate the invention.

Referring to FIGS. 8 and 10, sleeve 112 of the prior art is removed from bore 74 of lower tubular member 68. Bore 74 is then enlarged to form enlarged bore 144. By way of illustration and not limitation, bore 144 may have a diameter between about 33 and 37 mm, ideally about 35 mm. A bearing 140 is inserted, followed by sleeve 142, finally a second bearing 140 is inserted, thereby forming smaller opening 145 coaxial within the inner race of bearings 140. The diameter of opening 145 within the inner raceways of bearings 140 is smaller than that of the bore within sleeve 112, thereby accommodating smaller pedal arm shaft 130 such that a snug fit is achieved. Additional bearings 140 may also be inserted within bore 144. If so, the length of sleeve 142 is reduced accordingly. Identical parts and procedures form an improved bore within right pedal arm 50. Bearings 140 are preferably roller bearings made from steel or steel alloys as are known to the art. Sleeve 142 may be made from a variety of materials, such as brass, brass alloys, aluminum, steel, steel alloys or suitable synthetic resins. Improved shaft 130 does not contact sleeve 142 in this improvement.

Improved pedal arm shaft 130 fits closely within opening 145. Rather than directly rubbing, the improved pedal arm shaft 130, therefore now pivots upon bearings 140, thus totally eliminating abrasion and wear to sleeve 142 and pedal arm shaft 130. If, however, pedal arm shaft 130 does become worn or damaged, it is readily replaced. The presence of bearings 140 also enhances the fluidity of the response of pedal arms 48–50 as exerciser 20 is being used. The improved fluidity of the response results in a greatly enhanced exercise experience.

As exerciser 20 is used, the exerciser weight and movement normally cause erosion of two components of pedals 44–46 (FIGS. 3 and 13). First, shoulder bolt 118 directly rubs against bushing 120. Second, shaft 70, disposed within bore 64, rubs directly against the pedal material surrounding bore 64. In both cases, normal use can result in wear and loss of tolerances critical to the smooth operation of exerciser 20. Specifically, erosion of the components causes binding, jerking and misalignment of critical parts thereby diminishing the effective use and performance of exerciser 20.

Improvements to left pedal 44 include enlarging bore 64 to a larger diameter of between about ⅝ to ⅞ inch, ideally about ¾ inch, thereby forming an improved bore 144 (FIG. 16). Improved bore 144 accommodates sleeve 146. Sleeve 146 is preferably an Oil-Lite™ brass sleeve or bushing with an outer diameter of about ¾ inch, an inner diameter of about ⅝ inch and a length of about 4½ inches. However, these dimensions may vary considerably and still be within the scope of this invention.

As shown in FIGS. 14–16, another improvement to left pedal 44 includes boring bushing 120 such that needle bearing 150 can be accommodated therein. Needle bearing 150 ideally has an outer and inner diameter of 9/16 inch and ⅜ inch, respectively, and a length of 16 mm. However, these dimensions may vary considerably in other embodiments of this invention. Shoulder bolt 118' is inserted within needle bearing 150, rather than bushing 120, itself. The smaller diameter portion 156' of shoulder bolt 118' is disposed completely within needle bearing 150. Smaller diameter portion 156' is longer than smaller diameter portion 156 of shoulder bolt 118, thus allowing smaller diameter portion 156' to dispose within bearing 150. By way of illustration and not limitation, needle bearing 150 may have outer and inner diameters of 9/16 inch and ⅜ inch and a length of about 16 mm. Smaller diameter portion 156' of shoulder bolt 118' disposes snugly within needle bearing 150 and has a diameter of about ⅜ inch. Thus, the threads 119' of shoulder bolt 118' engage the threads within bore 124 (not shown) such that larger diameter portion 154' remains exterior to bearing 150. In the prior art, the larger diameter portion 154 and smaller diameter portion 156 of shoulder bolt 118 were both disposed within bushing 120. The same parts and procedures are used to form improvements to right pedal 46. Needle bearing 150 and shoulder bolt 118' may be made from steel, steel alloys, or other materials known to the art.

The above improvements to pedals 44–46 eliminate essentially all of the wear and erosion to the pedals of the prior art device encountered during normal use. Thus, critical tolerances are maintained. Moreover, bearing 150 and sleeve 146 are easily replaced, thereby further increasing the reliability, safety and performance of exerciser 20.

As shown in FIGS. 1, 2 and 17, tubular member 114 on leveling arm 52, as well as that on leveling arm 54, also rubs against leveling arm shaft 55 during use. The portion of tubular member 114 adjacent to bore 116 and shaft 55 may not wear as quickly as other components. However, to enhance reliability, it is necessary to strengthen tubular member 114 by providing an increased thickness thereto.

Figure 18:
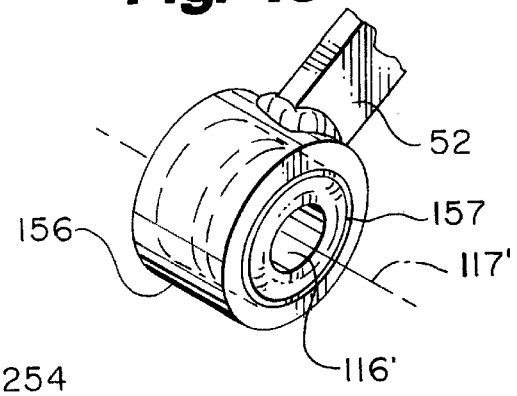
FIG. 18 is a detailed fragmentary perspective view of another portion of the invention.
Figure 19:
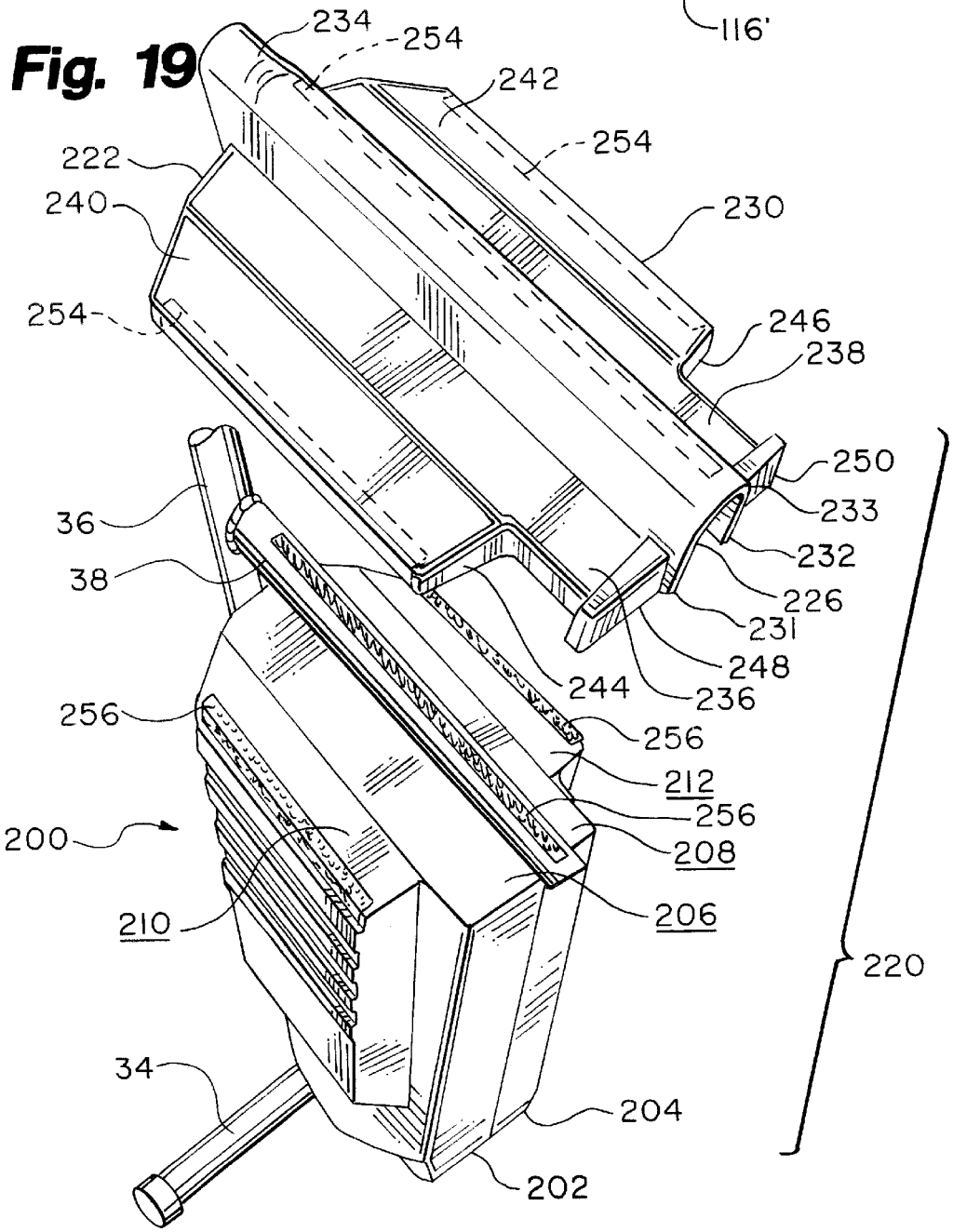
FIG. 19 is a fragmentary, top perspective view of the improved shield assembly with the top shield in a raised position prior to emplacement.
Figure 20:
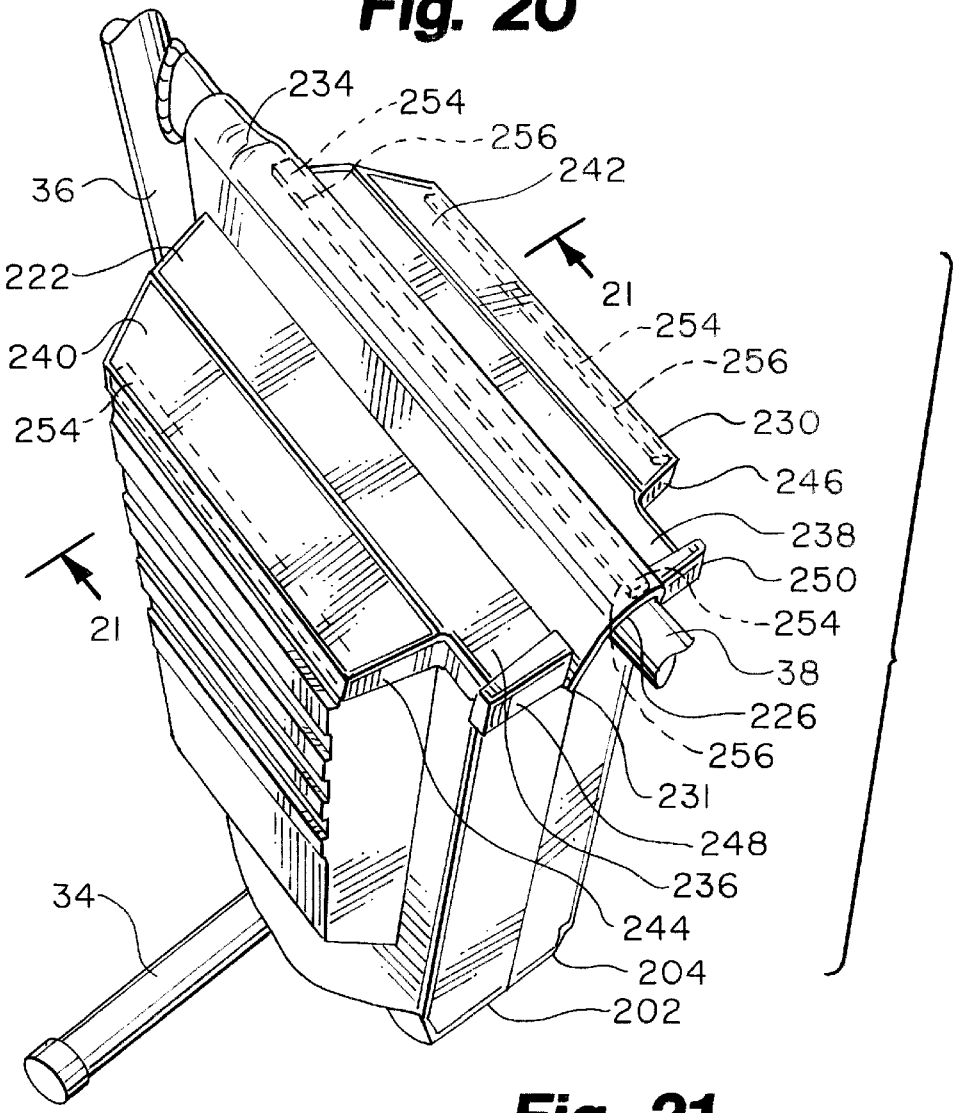
FIG. 20 is a fragmentary, top perspective view of the improved shield assembly with the top shield emplaced.
Figure 21:
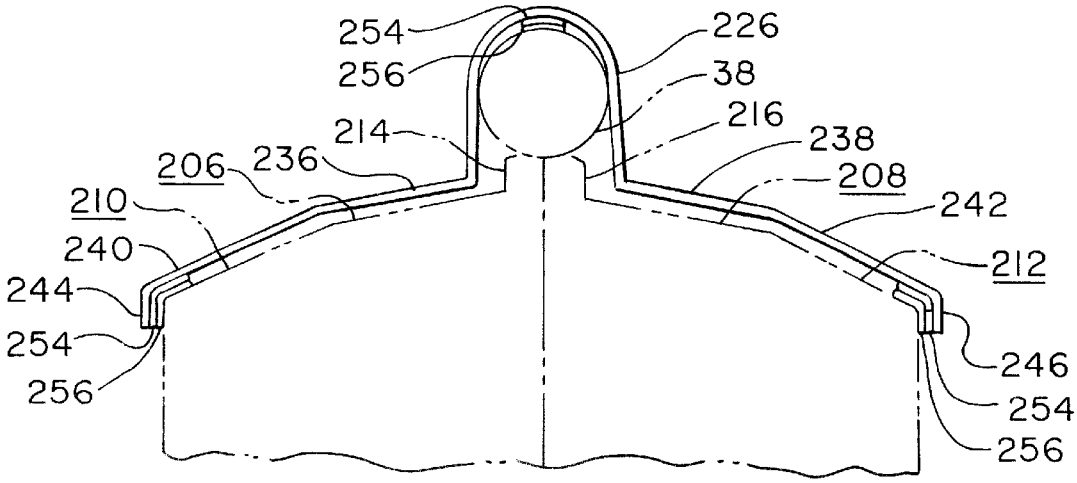
FIG. 21 is a sectional view of the improved assembly along line 21—21 of FIG. 20.

Referring to FIGS. 17–18, left leveling arm 52 is improved by removing tubular member 114 and a portion 115 of left leveling arm 52 adjacent to tubular member 114. Tubular member 114 is then replaced with tubular member 156. The exterior diameter of member 156 is larger than that of member 114, thus accommodating bearing 157 therewithin. Opening (or bore) 116', within the inner raceway of bearing 157, has the same diameter as bore 116 of tubular member 114. Also the distance between the longitudinal axis 125' of bore 124' remains the same as the distance between the longitudinal axis 117 of bore 116 to the longitudinal axis 125 of bore 124 of the prior art. An identical improvement is made to right leveling arm 54. Alternatively, bore 116' may be enlarged to accommodate one or more bearings resembling bearings 140 (FIG. 10). Thus, shaft 55 would dispose within the inner races of these bearings, thereby essentially eliminating wear to these components. These improvements to leveling arms 52–54 both strengthen them and add thickness to their terminal members in contact with leveling arm shaft 55.

As may be seen from FIGS. 3 and 11, the entire force imparted by the user's weight is exerted against bearing assembly 104 of the prior art during normal use. However, bearing assembly 104 is often inadequate to sustain prolonged use of this nature. The result is that bearing assembly 104 erodes to the extent that bearings 110 therewithin may seize, become bent, or wear completely through. Furthermore, if bearings 110 do wear completely through, tab 76 directly contacts pin 106 of master link 102. Thus, tab 76 and pin 106 wear away as well.

Figure 12:
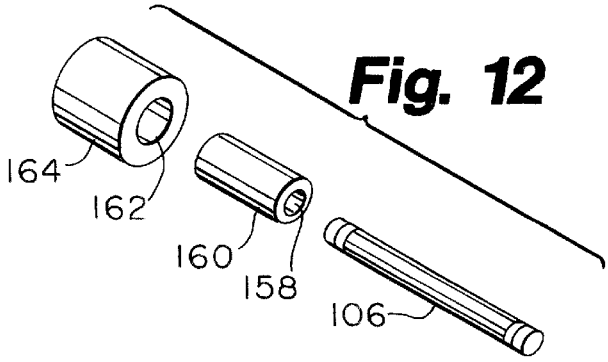
FIG. 12 is an exploded view of another portion of the invention in detail.

In an improved attachment mechanism (FIGS. 3 and 12), chain 56 is attached to winglet 72 of left pedal arm 48 by inserting pin 106 into bore 158 of sleeve 160. Sleeve 160, in turn, is received into bore 162 of bushing 164. Bushing 164 is accommodated in bore 78 of winglet 72. The same improvement is made to the right chain. Sleeve 160 and bushing 164 are preferably Oil-Lite™ bushings but may be impregnated or coated with other lubricating substances or may be made of other friction-reducing materials. By way of illustration and not limitation, sleeve 160 has outer and inner diameters of about ¼ inch and ⅛ inch, respectively, the inner diameter to accommodate pin 106. Bushing 162, in turn, has an outer diameter of either about ⅝ or 11/16 inch and an inner diameter of about ¼ inch, the inner diameter to accommodate sleeve 160. Lengths of sleeve 160 and bushing 162 are determined by the width of master link 102. Moreover, the inner and outer diameters of sleeve 160 and bushing 162 may vary suitably, depending upon whether bore 78 is enlarged. These improvements greatly strengthen the mechanism upon which the entire weight of the user and the associated dynamic muscular exertions are imposed. These improvements further provide two surfaces which are capable of sustaining the abrasive forces normally encountered during long and sustained workouts. Furthermore, each of the components is easily replaceable, thereby further enhancing the useful life of exerciser 20.

Referring to FIGS. 1, 2, 19–21, mechanical assembly 26 of exerciser 20 is normally covered and protected by left side panel 202 and right side panel 204. Left side panel 202 and right side panel 204 mate and are connected below transverse support member 38. Left and right side panels 202 and 204 are complementary in shape, each side panel including an upper surface 206, 208, a sloped surface 210, 212 and an attachment lip 214, 216, respectively. Upper surfaces 206, 208 extend laterally from attachment lips 214, 216. Sloped surfaces 210, 212, in turn, extend laterally from upper surfaces 206, 208. A plurality of snaps or equivalent securing devices may be present on lips 214, 216 to secure them in place.

Improved shield assembly 220 includes left and right side panels 202, 204, from the prior art and top shield 222. Top shield 222, in turn, includes saddle member 226, left member 228, and right member 230. Generally U-shaped in cross section, saddle member 226 may be visualized as including a left base 231, right base 232 and apex region 233. Apex region 233 includes a depressed area, or dimple, 234 proximate to its front end.

A portion of saddle member 226 trajects forwardly, beyond left and right members 228, 230. This forward projection of saddle member 226 angles downwardly from apex region 233 towards bases 231, 232.

Left and right members 228, 230 include left planar element 236, right planar element 238, left sloped element 240, right sloped element 242, left skirt 244, right skirt 246, left rear wall 248, and right rear wall 250. Left and right planar elements 236, 238 extend at a slight downward angle from the perpendicular bases 231, 232, respectively. Left and right sloped elements 240, 242, in turn, extend generally laterally and at a downward angle from left and right planar elements 236 and 238, respectively. Left and right rear walls 248, 250 form the rearmost portions of left and right planar elements 236 and 238. Left and right rear walls 248, 250 extend above the upper surface and further extending laterally beyond the lateral extent of left and right planar elements 236 and 238. Extending downwardly from the peripheries of left and right planar elements 236, 238 and of left and right sloped elements 240, 242 are left skirt 244 and right skirt 246.

Present on the under surfaces of top shield 222 may be hook and loop fastener sections 254 (shown in phantom). Complementary hook and loop fastener sections 256 may also be present on left and right side panels 202, 204 and on an upper surface of transverse support member 238. Other fastening means may be employed in addition to hook and loop fastener sections 254, 256, or to the exclusion thereof.

The general shape of top shield 222 is such that it conforms closely to upper surfaces 206, 208 and sloped surfaces 210, 212 of left and right side panels 202, 204, respectively. Moreover, peripheral skirts 244, 246 enclose upper portions of the vertical surfaces of left and right side panels 202, 204.

In use, top shield 222 is emplaced such that saddle member 236 extends above transfer support member 238, and such that left and right planar elements 236, 238 are positioned above upper surfaces 206, 208, left sloped elements 240, 242 are positioned above sloped surfaces 210, 212, and finally such that left and right skirts 244, 246 will enclose upper portions of vertical surfaces of side panels 202, 204 when top shield 222 is secure and in place. Ideally, top shield 222 is secured in place by hook and loop fasteners or other means, as described above. One advantageous feature of top shield 222 is dimpled area 234. Dimpled area 234 enables saddle member 226 to conform closely to the upper contours of transverse support member 38, thereby preventing infiltration of foreign objects or greatly limiting the infiltration of liquids thereunder. Still another advantageous feature of top shield 222 includes those provided by left and right rear walls 248, 250. When exercise apparatus 20 is being used, persons often consume liquids when exercising and may spill these liquids onto top shield 222. Moreover, persons exercising thereon may perspire profusely onto top shield 222. The upper and lateral extensions of left and right rear walls 248, 250 cooperate in channeling these liquids off the upper surface of top shield 222, toward the rear, finally off the side. Thus, the downwardly oriented slope of emplaced top shield 222 and the above-mentioned extensions of left and right rear walls 248, 250 act to prevent liquids from entering the vicinity of mechanical assembly 26 and damaging or corroding the elements thereof.

Moreover, in the absence of top shield 222, persons exercising on exercise apparatus 20 frequently place their feet on upper surfaces of either left or right side panels 202, 204. The force of the weight of the exerciser's feet frequently jar side panels 202, 204 apart, thereby dislodging them from the exerciser apparatus. This dislodgement frequently damages side panels 202, 204. Furthermore, without side panels 202, 204 in place covering and protecting mechanical assembly 26, the exercising person may either damage mechanical assembly 26 or injure their foot thereon. Top shield 222, when in place, will prevent dislodgement of left and right side panels 202, 204. Top shield 222 will remain in position despite the weight of a persons' foot on either or both sides of saddle member 226.

Top shield 222 is preferably made of a strong, resilient material such as a molded, synthetic resin or equivalent. The length of apex region 233 of saddle member 226 may be between 18 and 19 inches, preferably 18.56 inches. The length of bases 231 and 232 of saddle member 236 may be between 17 and 18 inches, preferably 17.38 inches. The height of saddle member 236 may be between 4 and 5 inches, preferably 4.88 inches and 4.73 inches proximate dimple 234. The width of saddle member 236 may be between 2 and 3 inches, preferably 2.25 inches. The widths and lengths of left and right planar elements 236 and 238 are between 1.5 and 2.5 inches and 15.5 and 16.5 inches, preferably 2 inches and 16 inches, respectively. The widths of left and right sloped elements 240 and 242 are between 2.5 inches and 3.5 inches, preferably 3 inches. The lengths of left and right sloped elements 240 and 242 are between 12 inches and 13 inches, sloping to between 10.5 inches and 11.5 inches, preferably 12.75 inches sloping to 11 inches. The maximum width of top shield 222 may be between 11 inches and 12 inches, preferably about 11.73 inches.

Because numerous modification may be made of this invention without departing from the spirit thereof, the scope of the invention is not to be limited to the embodiments illustrated and described. Rather, the scope of the invention is to be determined by the appended claims herein and their equivalents.

What is claimed is:

1. A system for providing improved operation and extending the useful life of an exercise machine, comprising:

a frame including a transverse support member extending generally from a front of the machine toward a rear of the machine;

a mechanical assembly disposed under the transverse support member and including a dynamic interface for improving wear resistance, reliability and maintainability of moving parts at critical stress and wear regions of the machine; and means for shielding the mechanical assembly of the machine, said shielding means comprising:

left and right side panels, each side panel including an upper surface having a lateral edge, the lateral edge having a rear portion, and a sloped surface having an outside edge and extending from the lateral edge of the upper surface, and a sidewall extending generally downwardly from the outside edge of the sloped surface, and a top shroud including a generally U-shaped saddle member, left and right planar elements extending laterally from the saddle member, each planar element having an outside edge and a rear edge, left and right sloped elements, each sloped element having an outside edge, the left and right sloped elements extending from the outside edge of the respective left and right planar elements, and left and right skirts extending generally downwardly from the outside edges of the respective left and right sloped elements, wherein:

the saddle member overlays the transverse support member, the left and right planar elements of the top shroud overlay the upper surfaces of the respective left and right side panels, the left and right sloped elements of the top shroud overlay the sloped surfaces of the respective left and right side panels, and the left and right skirts enclose upper portions of the respective left and right side panels.

2. The system of claim 1, the shielding means further comprising means for fastening the top shroud to the transverse support member.

3. The system of claim 2, the fastening means comprising hook and loop fasteners.

4. The system of claim 3, in which the hook and loop fasteners are disposed on an upper surface on the transverse support member and an adjacent portion of a lower surface of the saddle member.

5. The system of claim 1, the shielding means further comprising means for fastening the top shroud to the left and right side panels.

6. The system of claim 5, the fastening means comprising hook and loop fasteners.

7. The system of claim 6, in which the hook and loop fasteners are disposed on upper surfaces of said left and right side panels and on adjacent portions of lower surfaces of the left and right sloped elements of the shroud.

8. The system of claim 1, the saddle member further comprising a portion projecting forwardly from the left and right planar elements, said portion having an apex.

9. The system of claim 8, the saddle member further comprising a depressed area present proximate the apex of the forwardly projecting portion.

10. The system of claim 1, in which the sidewall of each side panel extends generally downwardly from the rear portion of the lateral edge of the upper surface.

11. The system of claim 1, the top shroud further comprising left and right rear walls extending generally upwardly from the rear edges of the respective left and right planar elements and having outside edges.

12. The system of claim 11, in which the left and right skirts extend generally downwardly from the lateral edges of the rearmost portions of the respective left and right planar surfaces and from the outside edges of the respective left and right rear walls.

* * * * *